United States Patent [19]

Kubota et al.

[11] 4,168,498

[45] Sep. 18, 1979

[54] IC DIGITAL DISPLAY DRIVE AND VOLTAGE DIVIDER CIRCUIT

[75] Inventors: Kanemitsu Kubota; Yoshikiyo Futagawa, both of Shiojiri, Japan

[73] Assignees: Kabushiki Kaisha Suwa Seikosha; Shinshu Seiki Kabushiki Kaisha, both of Tokyo, Japan

[21] Appl. No.: 738,764

[22] Filed: Nov. 4, 1976

[30] Foreign Application Priority Data

Nov. 4, 1975 [JP] Japan ..... 50-132350

[51] Int. Cl.[2] ..... G09F 9/32

[52] U.S. Cl. ..... 340/811; 340/784; 340/805; 307/209; 307/296 R

[58] Field of Search ..... 328/75; 307/296, 209, 307/270, 215, 205; 340/324 M, 336; 350/160 LC, 330, 331, 333; 357/41, 42, 51

[56] References Cited

U.S. PATENT DOCUMENTS

| | | | |
|---|---|---|---|
| 3,207,922 | 9/1965 | Gruodis et al. | 307/209 |
| 3,467,952 | 9/1969 | Shiraishi et al. | 357/42 |
| 3,492,496 | 1/1970 | Callan . | |
| 3,508,084 | 4/1970 | Warner, Jr. | 357/41 |
| 3,936,676 | 2/1976 | Fujita | 307/209 |
| 3,976,362 | 8/1976 | Kawakami | 340/324 M |
| 4,019,178 | 4/1977 | Hashimoto et al. | 340/324 M |

*Primary Examiner*—Marshall M. Curtis

*Attorney, Agent, or Firm*—Blum, Moscovitz, Friedman & Kaplan

[57] ABSTRACT

An improved interfacing circuit that is readily adapted to be integrated into the same circuit chip as the remaining circuitry in an electronic instrument having a digital display formed of passive display elements, and is adapted to deliver a plurality of discrete voltage levels to the digital display drive circuitry is provided. Specifically, a two-terminal voltage supply is provided for producing a first voltage level at a first terminal and a second voltage level at a second terminal. The interfacing circuit includes a voltage divider circuit having at least two series-coupled resistance circuits coupled intermediate the respective first and second terminals of the voltage supply so that the junction defined by the coupling of each pair of series-coupled resistance circuits and the first and second terminals of the voltage supply are respectively coupled to the digital display drive circuitry for delivering a plurality of discrete voltage levels thereto.

11 Claims, 9 Drawing Figures

IC DIGITAL DISPLAY DRIVE AND VOLTAGE DIVIDER CIRCUIT

BACKGROUND OF THE INVENTION

This invention is directed to improved circuitry for driving a digital display formed of passive display elements and in particular to interfacing circuitry that is capable of delivering a plurality of discrete voltage levels to a drive circuit for driving a digital display formed of passive display elements.

While digital displays in electronic instruments requiring a large number of digits, such as calculators and the like, have taken on various forms, a preferred manner of driving a large number of display digits is by multiplex driving of the respective display digits. Multiplex driving is preferred because the circuitry required to effect same is particularly suitable for being integrated into a single circuit chip, such as an LSI chip. Integration of a multiplex driving circuit into a single chip permits the size of the chip to be reduced, reduces the number of connections between the LSI chip and the display elements, and hence simplifies the bonding therebetween, thereby increasing the yield and reducing the cost of manufacturing such integrated circuit chips.

Such multiplex driving of the digital display is particularly effective in driving digital displays of the passive variety, such as those having liquid crystal display elements, in addition to digital displays formed of light emitting diodes, fluorescent display tube, and other like elements that admit of a rectifying characteristic. It is noted however, that multiplex driving of digital displays formed of passive display elements require one-half ($\frac{1}{2}$) or one-third ($\frac{1}{3}$) AC biasing mode driving, and thereby require a plurality of discrete voltage levels to be delivered to the multiplex drive circuitry. It has been found that the type of circuitry heretofore utilized to deliver discrete voltage levels to the multiplex drive circuit chip are not particularly suited to being integrated into the same circuit chip as the multiplex driving circuitry.

SUMMARY OF THE INVENTION

Generally speaking, in accordance with the instant invention, an interfacing circuit for use in a digital display electronic instrument for delivering a plurality of discrete voltage levels to the digital display drive circuitry is provided. The electronic instrument includes a two-terminal voltage supply for producing a first voltage level at a first terminal and a second voltage level at a second terminal. The interfacing circuit is characterized by voltage divider circuitry including at least two series-coupled resistance circuits, coupled intermediate the respective first and second terminals of the voltage supply. The first and second terminals of the voltage supply and the junctions defined by the coupling of each pair of series-coupled resistance circuits are each coupled to the digital display drive circuitry to thereby apply to the drive circuitry at least a plurality of discrete voltage levels corresponding to said first and second voltage levels and further discrete voltage levels having a magnitude between said first and second voltage levels, the number of further discrete voltage levels being equal to the number of junctions formed by the series-coupled resistance circuits.

Accordingly, it is an object of this invention to provide an interfacing circuit for delivering a plurality of discrete voltage levels to a digital display drive circuit.

It is a further object of the instant invention to provide an improved multiplex driving circuit for driving digital displays formed of passive display elements.

Still a further object of the instant invention is to provide interfacing circuitry for a digital display electronic instrument that is readily integrated into the same circuit chip to thereby reduce the cost of manufacturing such electronic instruments.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in conjunction with the accompanying drawings, in which.

DETAILED DESCRIPTION OF THE PREFERRED EMBODIMENTS

Figure 1:
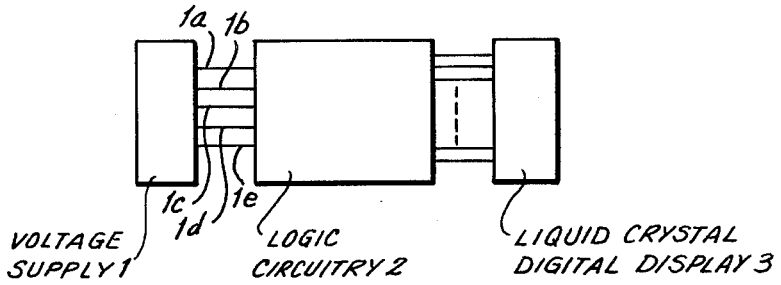
FIG. 1 PRIOR ART
FIG. 1 is a block circuit diagram of an electronic instrument, having a digital display formed of passive display elements, constructed in accordance with the prior art.
Figure 4A:
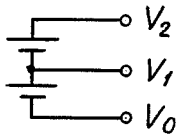
FIG. 4a PRIOR ART
FIGS. 4*a*, 4*b* and 4*c*, respectively illustrate prior art voltage supply cascading arrangements for delivering a plurality of discrete voltage levels to a time-division multiplexing digital display drive circuit.
Figure 4B:
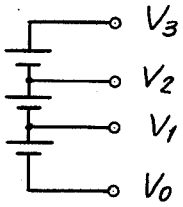
FIG. 4b PRIOR ART
Figure 4C:
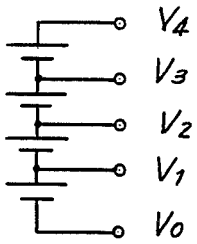
FIG. 4c PRIOR ART

Reference is now made to FIG. 1, wherein a block circuit diagram of a typical digital display electronic instrument, such as electronic calculator, having a liquid crystal digital display is depicted. A voltage supply 1 is adapted to deliver through a plurality of lead terminals 1*a* through 1*e*, to the logic circuitry 2, a plurality of discrete voltage levels, which logic circuitry performs a particular operation and drives a liquid crystal digital display 3 in order to provide a numerical display of the operation performed by the logic circuitry 2. For example, in an electronic table calculator, the circuitry 2 would include a counter circuit, an input circuit for inputting to the calculator circuitry information from the keyboard, a display-driving circuit, and those other circuits such as registers, etc., required for the electronic instrument to operate as a calculator. It is noted that, with the exception of the voltage supply 1, which consists of a plurality of cascaded voltage cells, more particularly illustrated in FIG. 4*c*, and the passive digital display formed of liquid crystal display elements, the remaining circuitry of the electronic calculator is formed into a single integrated circuit chip, such as an LSI chip, thereby reducing the cost of providing circuitry for the electronic timepiece to the cost of manufacturing the LSI chip. As is explained in greater detail below, the discrete voltage levels, delivered through each terminal, by the voltage supply 1, are required for the digital display driving circuitry to drive liquid crystal display cells, and other like passive display elements in a time-division multiplexing mode.

Figure 2:
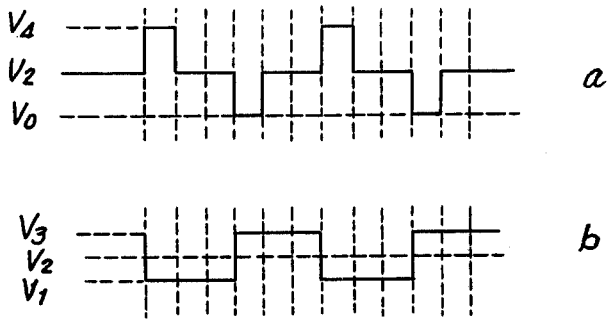
FIG. 2 PRIOR ART
FIG. 2 is a wave diagram illustrating a digit drive signal and a data drive signal produced by a time division multiplexing one-third ($\frac{1}{3}$) AC biasing mode digital display drive circuit, constructed in accordance with the prior art.

Reference is now made to wave forms a and b in FIG. 2, wherein wave forms exemplifying the manner in which a digital display formed of passive display elements and having groups of three digits, driven in a one-third ($\frac{1}{3}$) AC biasing mode, are depicted. Wave form a illustrates a digit signal having three voltage levels, $V_0$, $V_2$, $V_4$, which signal is utilized to select a digit to be energized. Wave form b is a data signal having two discrete voltage levels $V_1$ and $V_3$ for selecting the predetermined data for selectively energizing the segment of the display digit selected by the digit signal. Thus, for a one-third ($\frac{1}{3}$) AC biasing mode, five distinct voltage levels, namely, $V_0$, $V_1$, $V_2$, $V_3$ and $V_4$ are needed to effect driving of the passive digital display elements. It is noted that the AC driving is necessary in order to extend the duration over which the liquid crystal display cells properly function.

Figure 3:
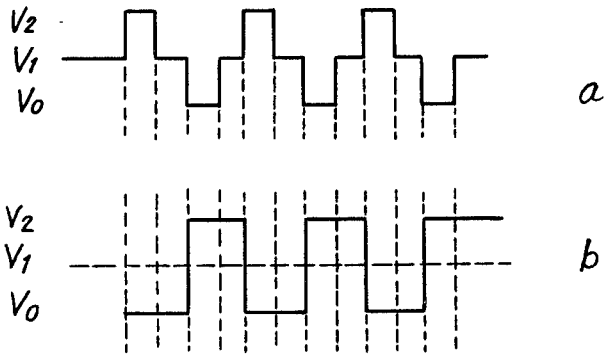
FIG. 3 PRIOR ART
FIG. 3 is a wave diagram illustrating a digit drive signal and a data drive signal produced by time-division multiplexing one-half ($\frac{1}{2}$) AC biasing mode digital display drive circuit, constructed in accordance with the prior art.

Similarly, reference is now made to FIG. 3, wherein wave forms a and b exemplifying the manner in which a digital display, formed of passive elements and having groups of two digits, are time-division multiplexed in a one-half ($\frac{1}{2}$) AC biasing mode are depicted. Wave form a is a digit signal having three discrete voltage levels $V_0$, $V_1$ and $V_2$ and wave form b is a data signal having two discrete voltage levels, $V_0$ and $V_2$, which voltage levels are equal to two of the voltage levels of the digit signal. Accordingly, in a one-half ($\frac{1}{2}$) AC biasing mode, time-division multiplexing is effected by having three discrete voltage levels $V_0$, $V_1$ and $V_2$ delivered to the time-division multiplexing drive circuit. Thus, the time division multiplexing circuitry of the type required to drive digital displays formed of passive elements are characterized by the requirement that at least three distinct voltage levels must be delivered thereto. Heretofore, the preferred arrangement for producing a plurality of discrete levels was to cascade voltage cells in series and tap the respective points at which same were coupled in the manner depicted in FIGS. 4*a*, 4*b* and 4*c*, like reference numerals being utilized to note like voltage levels obtained in each arrangement. Thus, by cascading five DC voltage cells in the manner depicted in FIG. 4*c*, five discrete voltage levels, $V_0$, $V_1$, $V_2$, $V_3$ and $V_4$ would be utilized as a voltage supply, of the type depicted in FIG. 1 for delivering five discrete voltage levels along leads 1*a* through 1*e* to the circuitry of the electronic instrument. Another method of generating a plurality of distinct and discrete voltage levels is to include in the voltage supply a transducer circuit for converting a single voltage into a multi-level voltage by means of a center terminal with a plurality of tap terminals. Also, a Schenkel-type or Cockcroft type voltage doubler boosting circuit in combination with an oscillator, a capacitor and a diode can be provided in the voltage supply for producing a plurality of discrete voltage levels.

It is noted however that the aforedescribed methods of providing a plurality of discrete voltage levels have proved to be less than completely satisfactory in digital display electronic instruments for the following reasons. Firstly, as illustrated in FIG. 1, since a plurality of leads 1*a* through 1*e* are required for delivering the discrete voltage levels from the voltage supply 1 to the circuitry 2, the number of connections to the integrated circuit chip is increased to the number of discrete voltage levels that are to be delivered to the circuitry. For example, in an electronic table calculator, wherein the entire calculator circuit is integrated into a single LSI chip, the cost of manufacturing the chip is increased by the number of connecting pads required. In order to reduce the cost of manufacturing the circuit chip, it is necessary to reduce the number of bonding pads. Moreover, by reducing the number of bonding pads, the size of the chip can be reduced, the reliability of the chip increased, and the time required to inspect such a chip minimized. It is therefore highly desirable that the number of bonding pads required to couple the voltage supply to the LSI circuit chip be minimized.

Secondly, when a plurality of cascaded voltage cells are utilized to produce the plurality of discrete voltage levels, an increase in the number of batteries and/or the number of oscillating circuits, and hence the number of circuit elements such as transistors, capacitors, diodes and the like, results, thereby increasing the cost of manufacturing the circuit chip. Moreover, the increased number of circuit elements makes it more difficult to miniaturize the electronic instrument, which miniaturization is important in hand held calculators, electronic wristwatches, electronic testers, etc. Accordingly, as detailed below, the instant invention is directed to providing an interfacing circuit adapted to be integrated into a single circuit chip for delivering to a time-division multiplex driving circuit a plurality of discrete voltage levels.

Figure 5:
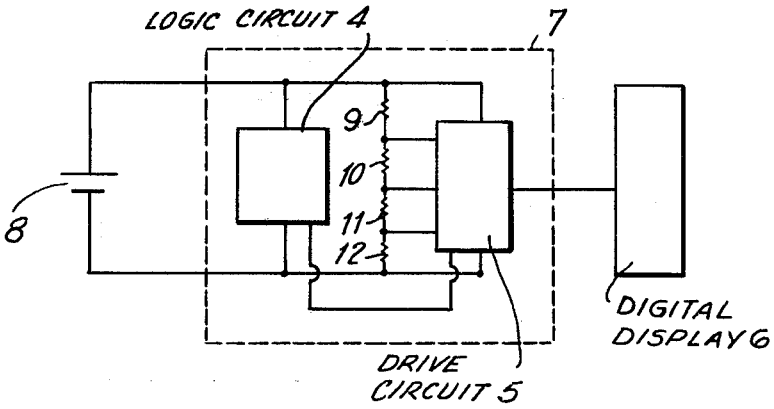
FIG. 5 is a circuit diagram of an electronic instrument having a digital display formed of passive display elements and including an interfacing circuit constructed in accordance with a first embodiment of the instant invention.

Reference is now made to FIG. 5, wherein a block circuit diagram of an electronic instrument, such as an electronic calculator, having an interfacing circuit constructed in accordance with the instant invention, is depicted. A single two-terminal DC voltage cell 8 is coupled to logic circuit 4 and time-division multiplexing drive circuit 5. For example, in an electronic calculator, the logic circuit 4 would include the keyboard input circuitry, calculator circuitry registers, clock pulse generating circuitry, etc., and the display drive circuit 5 would include conventional one-third ($\frac{1}{3}$) AC biasing mode time-division multiplex drive circuitry for driving a digital display formed of passive display elements. The drive circuit 5 is coupled to digital display 6 formed of conventional seven-bar liquid crystal display cells. The interfacing circuit includes resistors 9, 10, 11 and 12, which resistors are coupled to the respective terminals of the digital display in a manner to be described in greater detail below. Finally, the logic circuit 4 is coupled to the driving circuit 5, and in combination with the resistors defining the interfacing circuit, are integrated into the same LSI chip 7.

The resistors 9 through 12 comprising the interfacing circuit, can be formed of a plurality of resistors having a resistance of several ten Ω to several ten MΩ. Each of the resistors are series-coupled with the respective junctions between the resistors coupled to the drive circuit 5. It is noted that when the resistors 9 through 12 are formed in the integrated circuit chip, the resistance can be predetermined by diffusing certain impurities such as phospher or boron into the substrate of the IC chip 7 or alternatively, such resistances can be obtained by applying a selected bias to the MOS transistors in the circuit chip 7.

In operation, the resistors 9 through 12 divide the voltage produced by the voltage supply 8 and thereby deliver five discrete voltages to the drive circuit. Specifically, two voltage levels are produced at the respective terminals of the DC voltage cell 8, and the three further discrete voltage levels are produced at respective junctions between the resistors 9 and 10, 10 and 11, and 11 and 12. Accordingly, the further discrete voltage levels have magnitudes that are between the magnitudes of the respective voltage levels produced at the two terminals of the DC voltage cell 8. Accordingly, the five discrete voltage levels required for a time-division multiplex circuit operating in a one-third ($\frac{1}{3}$) time division multiplexing mode, are delivered by the interfacing circuit, which interfacing circuit is integrated as part of the integrated circuit chip of the electronic instrument. Moreover, it is only necessary to couple two terminals of the voltage supply to the LSI chip, thereby clearly reducing the number of coupling pads required in the circuit chip and also reducing the number of elements in the electronic instruments that are not included in the integrated circuit chip, thereby further reducing the cost of manufacturing the single LSI chip, and hence the cost of producing the electronic instrument.

Figure 6:
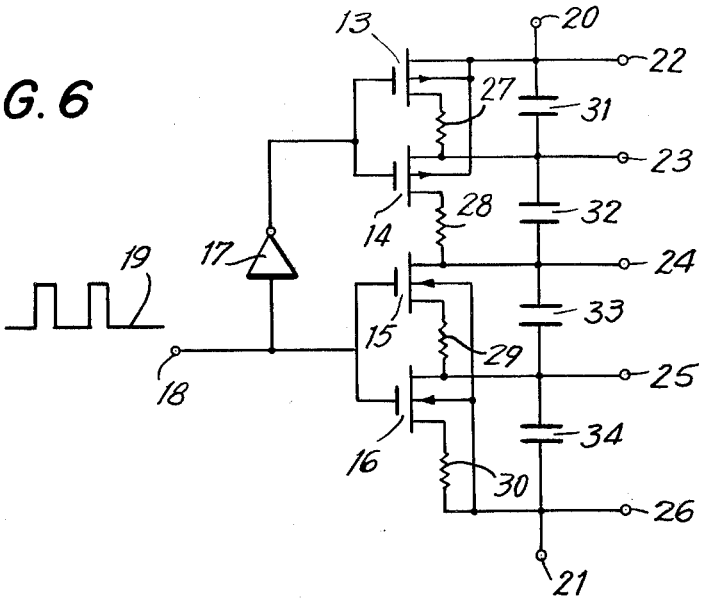
FIG. 6 is a detailed circuit diagram of an interfacing circuit constructed in accordance with a second embodiment of the instant invention.

Reference is now made to FIG. 6, wherein an interfacing circuit, constructed in accordance with a further embodiment of the instant invention, for delivering a plurality of discrete voltage levels to a drive circuit, is depicted. The interfacing circuit depicted in FIG. 6 is particularly characterized by the use of P-channel and/or N-channel MOS transistors as switching elements. Specifically, P-channel transistors 13 and 14 have a commonly coupled gate electrode coupled through an inverter 17 to an input terminal 18. Similarly, N-channel MOS transistors 15 and 16 have their gate electrodes commonly coupled to the clock signal receiving input terminal 18. The source-drain electrodes of MOS transistors 13, 14, 15 and 16 are respectively coupled through resistors 27, 28, 29 and 30 to define five discrete voltage levels at output terminals 22, 23, 24, 25 and 26. Specifically, the output terminals 22 and 26 are referenced to the voltage supply terminals 20 and 21, while the output terminals 23, 24 and 26 are referenced to the junctions between the respective resistance circuits defined by MOS transistor 13 and resistor 27, P-channel transistor 14 and resistor 28, N-channel MOS transistor 15 and resistor 29 and N-channel MOS transistor 16 and resistor 30. Stabilizing capacitors 31, 32, 33 and 34 are coupled between the respective output terminals 22 and 23, 23 and 24, 24 and 25, and 25 and 26.

The pulse signal 19 represents a two-stage oscillatory clock signal produced by a typical pulse generating circuit included in an electronic calculator or other similar type electronic instrument. Accordingly, when the state of the clock signal 19 is positive or "1", each of the MOS transistors 13 through 16 are turned ON so that the source-drain paths thereof are rendered conductive, and the supply voltage across the respective terminals 20 and 21 is divided by the conductive resistance of each of the switching circuits. Specifically, the resistance of the switching circuit refers to the combined resistance of the source-drain path of the MOS transistor and the resistor series-coupled therewith, when the MOS transistor is turned ON. It is, of course, noted that the MOS transistors can be formed with a sufficient source-drain resistance during fabrication of the circuit chip to provide a sufficient resistive circuit resistance to permit the resistor 27 to be omitted.

When each of the P-channel transistors 13 and 14 and N-channel transistors 15 and 16 are turned ON, the capacitors 31, 32, 33 and 34 are all fully charged to the discrete voltage levels produced at the respective output terminals 22, 23, 24, 25 and 26, in response to the voltage being divided between the respective resistance circuits. Moreover, when the clock pulse 19 in a low state, or "0" state, the MOS transistors 13 through 16 are turned OFF and hence, are non-conductive thereby substantially eliminating all current flow. Accordingly, during the negative cycles of the clock signal, the capacitors 31, 32, 33 and 34 maintain the respective output terminals 22 through 26 at the discrete voltage levels and thereby permit the interfacing circuit to continue to deliver a plurality of discrete voltage levels.

Accordingly, the interfacing circuit described above, and depicted in FIGS. 6, is readily integrated into the same circuit chip as the time division multiplexing drive circuit and clearly produces the plurality of discrete voltage levels required for operation by the multiplexing drive circuit, thereby permitting the cost of manufacturing the LSI chip to be reduced. Moreover, by utilizing an interfacing circuit that is capable of delivering a plurality of discrete voltage levels to the drive circuit by having the switching elements thereof intermitently turned ON and OFF, a considerable reduction in power consumption obtains, thereby lengthening the life of the DC battery utilized as a power source in the electronic instrument. As is noted above, the clock pulse 19 is readily obtained in electronic instruments since instruments such as table calculators, pocket calculators, digital measuring instruments, electronic timepieces and the like, are always provided with a circuit for generating a clock signal.

Moreover, as noted above, the requisite resistances needed to effect a dividing of the supply voltage into a plurality of discrete voltage levels, can be obtained by fabricating the MOS transistors to have a predetermined conductivity on the order of several KΩ to several ten KΩ to thereby permit the elimination of the resistors 27 through 30. It has also been observed that variations in the resistance value of the switching transistors 13 through 16 and resistors 27 through 30 caused by changes in temperature and by inherent manufacturing characteristics, such variations are sufficiently small between elements in the same IC (or LSI) chip that it can be disregarded. It is further noted, that parasitic capacitances of the respective integrated circuit elements can be utilized to eliminate the capacitors 31 through 34 and still obtain the same voltage stabilization when the clock signal is in the low or negative state.

Figure 7:
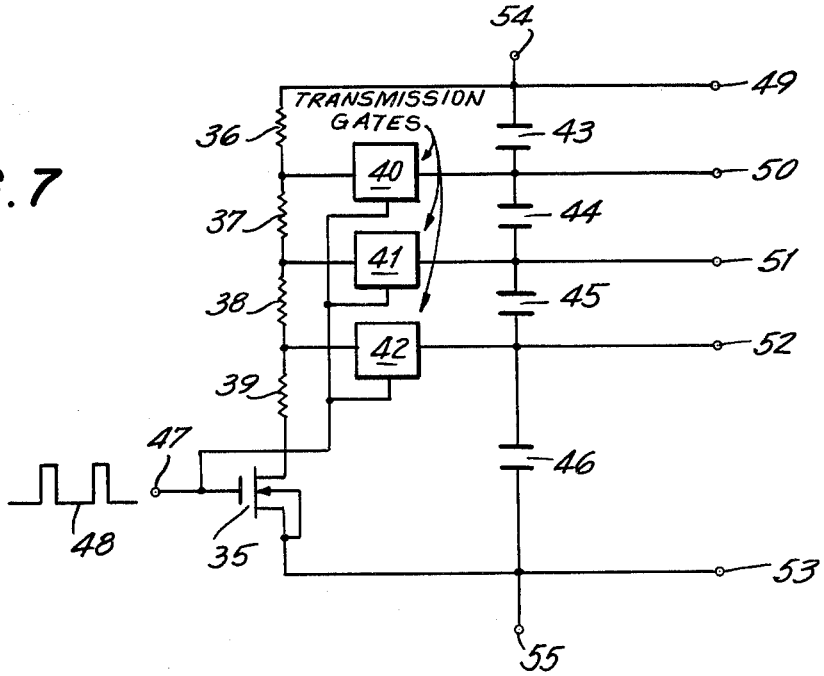
FIG. 7 is a detailed circuit diagram of an interfacing circuit constructed in accordance with a third embodiment of the instant invention.

Reference is now made to FIG. 7, wherein an interfacing circuit for delivering a plurality of discrete voltage levels to a time-division multiplexing drive circuit, constructed in accordance with still a further embodiment of the present invention is depicted. A plurality of series-coupled resistors 36, 37, 38 and 39 are coupled through the source-drain path of a N-channel MOS transistor 35 to one terminal 55 of a DC voltage supply.

The resistor 36 is coupled to terminal 54, which terminal is the other terminal of the two terminal voltage supply. The junctions between each series-coupled resistor 36 and 37, 37 and 38 and 38 and 39 are respectively coupled through transmission gates 40, 41 and 42 to output terminals 50, 51 and 52, respectively. Stabilizing capacitors 43, 44, 45, and 46 are disposed between the respective output terminals 49 and 50, 50 and 51, 51 and 52, 52 and 53 to stabilize the voltage levels thereat when the N-channel switching transistor 35 is turned OFF, and hence function in the same manner as the stabilizing capacitor described above in the interfacing circuit embodiment depicted in FIG. 6.

The transmission gates 40 and 42 are conventional bidirectional transmission gates formed of switching elements such as, for example, parallel coupled N-channel transistors with the gate electrodes commonly coupled to the gate electrode 35 of the N-channel switching transistor 35, and hence to the input terminal 47 that receives the clock signal 48. The input terminal 47 receives a two-state clock signal 48, which clock signal is produced by the clock signal generator that is, as noted above, included in electronic instruments such as calculators, timepieces, digital testers and the like.

Accordingly, when the clock signal 48 is in a positive state, the N-channel MOS switching transistor 35 is turned ON as are the transistors comprising the transmission gates 40 through 42, thereby permitting current to flow through the respective resistance circuits defined by resistor 38 and transmission gate 40, resistor 37 and transmission gate 41, resistor 38 and transmission gate 42, and resistor 39 and switching transistor 35, to thereby produce five discrete voltage levels at the output terminals 49 through 53. Specifically, the voltage levels 49 and 53 are the same as the voltage levels applied at terminals 54 and 55, whereas the voltage levels at the terminals 50, 51 and 52 are defined at the junctions between the respective resistance circuits noted above. The discrete voltage levels are stored in the capacitors 43 through 46 during the positive cycle of the two-state clock signal 48.

When the clock signal is in a negative state, N-channel switching transistor 35 is turned OFF and transmission gates 40 through 42 are rendered non-conductive, thereby preventing current flow in the respective series-connected resistors 36 through 39. Nevertheless, the capacitors 43 through 46 sustain the voltage levels at the output terminals 49 through 53 as long as the negative state of the clock signal has a duration that is less than the time required to permit the capacitors to be substantially discharged. Moreover, because passive display elements, such as liquic crystal display cells, have an extremely high internal impedance, on the order of several ten K, the discharge of the capacitors during the negative cycle of the clock signal 48 is slight, due to the small current flow at such times, so that the respective voltage levels are sufficiently sustained over the period that the clock signal is in the negative cycle.

Accordingly, like the above-noted embodiments, the interfacing circuit depicted in FIG. 7 is particularly characterized by the reduction in the number of input terminals to the IC (or LSI) chip and the benefits which inure thereto. Moreover, like the embodiment depicted in FIG. 6, the use of MOS switching transistor 35 and to a certain extent MOS transmission gates 40 through 42, results in the current consumption of the circuit being sharply reduced, thereby lengthening the useful life of the DC voltage supply.

Also, as noted above, the parasitic capacitance of digital displays formed of passive display elements, and additionally, the parasitic capacitance inherent in the integrated circuit chip can be utilized as a stabilizing capacitance, thereby permitting the capacitors 43 to 46 to be omitted. Additionally, the transmission gates can be utilized in combination with the circuitry of the multiplexing drive circuit to thereby eliminate several of the components in the drive circuit.

Accordingly, the following advantages are obtained by an interfacing circuit constructed in accordance with the instant invention. First, the number of terminals on the IC (or LSI) chip is reduced, thereby reducing the number of bonding pads required to be formed on the chip, increasing the reliability of the circuit chip, and facilitating inspection of the circuit chip. Secondly, the reduction in the number of circuit elements such as transducers, capacitors, diodes, etc., and the corresponding reduction in cost and simplification in manufacturing such electronic instrumentation is apparent.

Moreover, it is noted that the interfacing circuit of the instant invention for producing a plurality of discrete voltage levels in electronic instruments such as portable calculators, testers, digital volt meters, electronic timepieces, and the like, can also extend the life of the DC cells utilized to energize same. Accordingly, in a preferred embodiment, C-MOS transistors are preferred, although the interfacing circuit can be realized by also utilizing P-MOS, N-MOS, E-D MOS, bi-polar IC and other like field-effect switching elements.

Although the division ratio in the aforedescribed embodiments for a one-third ($\frac{1}{3}$) AC biasing mode is 1:1:1:1, the division ratio can be arbitrarily determined. For example, if the division ratio is $(\sqrt{n}-1):1:1:(\sqrt{n}-1)$, wherein n is the duty ratio, the effective voltage ratio of the turn-ON voltage and turn-OFF voltage can be extremely large.

Finally, among the passive type display elements, other than liquid crystal display cells to which the instant invention is particularly suited, are TN-type, DSM-type and DAP-type display cells. Also, other liquid crystal display elements such as those utilizing dies having two distinct color tones, are the type of passive elements to which the instant invention is particularly directed.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A digital display electronic instrument including a two terminal voltage supply for producing a first voltage level at a first terminal and a second voltage level at a second terminal, and drive circuit means for selectively driving said digital display in response to receiving a plurality of discrete voltage levels, the improvement comprising voltage divider means including at least two series-coupled resistance means coupled intermediate said respective first and second terminals of said voltage supply means, said first and second terminals of said voltage supply means and each junction defined by coupling a pair of series-coupled resistance means being coupled to said drive circuit means to thereby apply to said drive circuit means at least a plurality of discrete voltage levels including voltage levels corresponding to said first and second voltage levels and further discrete voltage levels having a magnitude between said first and second voltage levels, the number of further discrete voltage levels being at least equal to the number of junctions formed by said series-coupled resistance means and including means for receiving a two-state oscillatory clock signal, each of said resistance means being coupled to said clock signal receiving means to detect one of the states of said two-state clock signal and in response thereto, deliver said discrete level voltages to said drive circuit means.

2. A digital display electronic instrument as claimed in claim 1, wherein said drive circuit means is a one-half AC bias mode time-division multiplexing circuit adapted to receive at least three discrete voltage levels, and the number of said resistance means equals at least two.

3. A digital display electronic instrument as claimed in claim 4, wherein said drive circuit means is a one-third AC biasing mode time-division multiplexing circuit adapted to receive at least four discrete voltage levels, the number of said resistance means equaling at least four.

4. A digital display electronic instrument as claimed in claim 1, wherein each of said resistance means includes field-effect transistor switching means having a first control electrode coupled to said clock signal receiving means for detecting a predetermined state of said clock signal, and in response to said predetermined state, said switching means being turned ON so that said respective resistance means each define a predetermined resistance.

5. A digital display electronic instrument as claimed in claim 1, wherein each said resistance means includes a field-effect transistor means having first control electrode means coupled to said clock signal receiving means, and two further current path electrode means, said current path electrode means of each resistance means being series-coupled so that the junctions therebetween define each of said junctions coupled to said drive circuit means for applying said further discrete voltage levels thereto.

6. A digital display electronic instrument as claimed in claim 5, and including a resistance means coupled in series intermediate one of said current path electrode means of each said field-effect transistor means and a further current electrode of the next series-coupled field-effect transistor means, the junction between said resistance means and said current path electrode of said next transistor means defining said junction that is coupled to said drive circuit means.

7. A digital display electronic instrument as claimed in claim 6, and including a plurality of output terminals, each said output terminal corresponding to coupling of the terminals of the supply means and the junctions coupled to the drive circuit means, and including at least one capacitance means being coupled between each pair of output terminals.

8. A digital display electronic instrument as claimed in claim 1, wherein said electronic instrument includes logic circuit means, said logic circuit means being integrated into the same circuit chip as said divider circuit means.

9. A digital display electronic instrument including a two terminal voltage supply for producing a first voltage level at a first terminal and a second voltage level at a second terminal, and drive circuit means for selectively driving said digital display in response to receiving a plurality of discrete voltage levels, the improvement comprising voltage divider means including at least two series-coupled resistance means coupled intermediate said respective first and second terminals of said voltage supply means, said first and second terminals of said voltage supply means and each junction defined by coupling a pair of series-coupled resistance means being coupled to said drive circuit means to thereby apply to said drive circuit means at least a plurality of discrete voltage levels including voltage levels corresponding to said first and second voltage levels and further discrete voltage levels having a magnitude between said first and second voltage levels, the number of further discrete voltage levels being at least equal to the number of junctions formed by said series-coupled resistance means and including means for receiving a two-state oscillatory clock signal, switching transistor means disposed in series with said series-connected resistance means, said switching transistor means including a control electrode coupled to said clock signal receiving means, for detecting a predetermined state of said clock signal received thereby, and in response thereto, permitting current to flow through said resistance means and thereby deliver said discrete voltage levels to said drive circuit means.

10. A digital display electronic instrument as claimed in claim 9, and including a plurality of output terminals, each said output terminal corresponding to coupling of the terminals of the supply means and the junctions coupled to the drive circuit means, and including at least one capacitance means being coupled between each pair of output terminals.

11. A digital display electronic instrument as claimed in claim 10, and including transmission gate means disposed intermediate the junction defined by the coupling of said series-coupled resistance means together and said output terminals defined by the coupling of said junctions to said drive circuit means, each said transmission gate means having a control electrode means coupled to said clock signal receiving means for detecting said predetermined state and in response thereto defining a closed current path between said junction and said drive circuit means.

* * * * *